US008122841B2

(12) United States Patent
Feger

(10) Patent No.: US 8,122,841 B2
(45) Date of Patent: Feb. 28, 2012

(54) DEVICE AND A METHOD OF CONNECTING AN ELECTRICAL POWER LINE BETWEEN A SHIP AND A TERMINAL

(75) Inventor: Damien Feger, Vernon (FR)

(73) Assignee: New Generation Natural Gas, Paris (FR)

( * ) Notice: Subject to any disclaimer, the term of this patent is extended or adjusted under 35 U.S.C. 154(b) by 160 days.

(21) Appl. No.: 12/225,400

(22) PCT Filed: Mar. 20, 2007

(86) PCT No.: PCT/FR2007/050967

§ 371 (c)(1),
(2), (4) Date: Sep. 19, 2008

(87) PCT Pub. No.: WO2007/107673

PCT Pub. Date: Sep. 27, 2007

(65) Prior Publication Data

US 2010/0218710 A1 Sep. 2, 2010

(30) Foreign Application Priority Data

Mar. 21, 2006 (FR) ..... 06 50973

(51) Int. Cl.
*B63B 21/00* (2006.01)

(52) U.S. Cl. ..... 114/230.2
(58) Field of Classification Search ..... 114/230.2
See application file for complete search history.

(56) References Cited

U.S. PATENT DOCUMENTS

| | | | | |
|---|---|---|---|---|
| 3,120,208 | A * | 2/1964 | Lawrie | 114/245 |
| 3,717,325 | A * | 2/1973 | Peterson | 254/382 |
| 4,421,049 | A * | 12/1983 | Cholet | 114/245 |
| 5,380,129 | A * | 1/1995 | Maloberti et al. | 405/166 |

FOREIGN PATENT DOCUMENTS

| | | |
|---|---|---|
| FR | 2647604 | 5/1989 |
| WO | WO 2006/008849 A1 | 1/2006 |

* cited by examiner

*Primary Examiner* — Stephen Avila
(74) *Attorney, Agent, or Firm* — Weingarten, Schurgin, Gagnebin & Lebovici LLP

(57) ABSTRACT

A ship that is to be coupled electrically to a terminal a method, and a method and a device for connecting an electrical power line (1) between a ship (3) and a terminal (5). The device includes an unwinder (7) for unwinding a traction cable (13) from the ship (3) towards a connection end (15) of the electrical power line (1); a lashing device (9) for lashing the traction cable (13) to the connection end (15); and a traction device (11) for pulling the electrical power line towards the ship (3) so as to connect the connection end (15) with an electrical interface (17*a*) of the ship (3).

25 Claims, 10 Drawing Sheets

DEVICE AND A METHOD OF CONNECTING AN ELECTRICAL POWER LINE BETWEEN A SHIP AND A TERMINAL

This application is a §371 national phase filing of PCT/FR2007/050967 filed Mar. 20, 2007.

FIELD OF THE INVENTION

The present invention relates to the field of connecting an electrical power line between a ship and a terminal. More particularly, it relates to connecting an electrical power line between a methane tanker and a gas terminal.

BACKGROUND OF THE INVENTION

It is known to connect an electrical power line between a ship and a port, e.g. in the manner presently in use for connecting a cruise ship to a local electricity mains network in order to avoid the ship running its generator unit while in port.

FIG. 9 is a highly diagrammatic view of a prior art device for connecting an electrical power line between a ship and a port.

The device comprises a power line 101 constituted by one or more cables terminated by one or more connectors 115. The power line 101 is supported via collars 116 by suspension lines 118 and systems 120 that can be moved on a crane 122.

That device thus serves to connect an electricity switchboard 117 to the local electricity network in the port 5. To make the connection, once the ship 3 has docked, and the power line 101 has been brought up to the ship 3, the crew makes use of one or more heaving lines 124 to bring the connector 115 of the power line 101 on board, and then take it to the switchboard 117. The connector 115 is connected to the switchboard 117 manually.

Nevertheless, that connection device presents several drawbacks.

The connection operations can be lengthy (typically more than one hour) and difficult, or even dangerous for the crew, or impossible under adverse weather conditions.

In addition, that kind of connection is not compatible with the security requirements that apply to methane tankers and terminals, in particular because of the need to be able to disconnect rapidly, and also because the power lines need to be isolated from the surroundings since the surroundings can be explosive.

Furthermore, the electrical power that can be transferred via that type of connection is limited, typically to less than 15 megawatts (MW), whereas the power installed on a methane tanker can be as much as 30 MW.

OBJECT AND SUMMARY OF THE INVENTION

The present invention thus seeks to mitigate the above-mentioned drawbacks by proposing a method and a device for safely and quickly connecting an electrical power line between a ship and a terminal.

These objects are achieved by a device for connecting an electrical power line between a ship and a terminal, the device comprising:

- unwinder means for unwinding a traction cable from the ship towards a connection end of said electrical power line;
- lashing means for lashing said traction cable to said connection end; and

- traction means for pulling said electrical power line towards the ship so as to connect said connection end with an electrical interface of the ship.

Thus, the power line can easily be taken by the traction cable from a storage zone beside the terminal for connection to the electrical interface of the ship. In addition, emergency disconnection can be achieved in simple manner by unwinding and then letting go of the end of the traction cable, thereby completely releasing the ship from the terminal.

In an aspect of the invention, the connection device includes float means for maintaining at least a portion of said power line below the surface of the water.

By being under water, the power line is not exposed to the risks of performing operations in an atmosphere that is potentially explosive. Thus safety is entirely compatible with the safety requirements that are applicable in particular to methane tankers and terminals.

The connection device may include return means for returning the power line towards the terminal when said power line is disconnected from the ship and the traction cable is released.

The power line can thus easily be brought back to its storage zone.

Advantageously, the connection device includes guide means for guiding said connection end towards said electrical interface so as to provide electrical coupling between the ship and the terminal. Thus, the connection can be made automatically.

Furthermore, the connection device can include a barge for supporting a terminal portion of the power line including said connection end, said barge including protection means for bearing against the hull of the ship.

Thus, the power line can be brought to the vicinity of the ship in order to be connected in a manner that is simple and quite safe.

Advantageously, the hull of said barge may include an opening enabling said terminal portion of the power line to be stored beneath the barge.

Thus, supporting the power line is made easier and safety is increased.

In a particular aspect, said terminal portion of the power line is stored on the barge and includes a double-walled covering.

Thus, the overhead portion of the power line can be protected from risks due to a potential explosive atmosphere. Furthermore, the double-walled covering enables the electrical conductors of the power line to be cooled by a fluid (e.g. water).

According to another particular aspect, said barge includes a caisson including gaskets surrounding the above-water portion of the power line and co-operating with the hull of the ship, with the hull of the barge, and with the water surface to form a zone that is airtight relative to the outside.

This makes it possible to isolate the above-water portion of the power line from the potentially explosive atmosphere, thereby increasing safety while making a connection.

Advantageously, the connection includes a blower located on the ship or the barge, for raising the pressure in said airtight zone, said blower taking air from a gas-free zone. Safety is thus further improved.

The connection device may include a source of inert gas for filling said airtight zone with inert gas.

The traction means may comprise a winch located on the ship for using the traction cable to pull the connection end of said power line.

Advantageously, the traction means include suspension means for compensating the weight of said power line.

The invention also provides a ship including an electrical interface for coupling electrically to a terminal, the ship comprising:

unwinder means for unwinding a traction cable towards a connection end of an electrical power line connected to the terminal;

lashing means for lashing said traction cable to said connection end; and traction means for pulling said electrical power line towards the ship in order to connect said connection end with said electrical interface.

In an embodiment, the hull of the ship includes a duct for passing the power line, said duct opening out below the water line.

Thus, by opening out below the water line, the duct serves to protect the power line from any explosive atmosphere.

Advantageously, the end of the traction cable includes a submersible buoy.

Thus, once it has gone through the opening of the duct, the end of the traction cable can easily be returned to the surface where it can be connected to the connection end of said power line.

In another embodiment, the hull of the ship includes a duct for passing the power line and opening out beneath the water line, and the duct is extended by a gastight covering.

Advantageously, said duct includes a watertight protection hatch.

Advantageously, the ship includes guide means including docking means for guiding said connection end of said power line towards socket means of the electrical connection interface. This enables the connection to be made quickly and in complete safety.

Said electrical connection interface may include a watertight protective cover.

Advantageously, the ship includes a control station that is accessible via a watertight door of the ship.

In particular, the ship may be a methane tanker.

The invention also provides an electrical coupling device comprising an electrical power line for connecting a ship to a terminal, the device comprising float means for maintaining at least a portion of said electrical power line below the surface of the water while it is being conveyed between the terminal and the ship.

The invention also provides a method of connecting an electrical power line between a ship and a terminal, the method comprising the following steps:

unwinding a traction cable from the ship towards a connection end of said electrical power line;

lashing said traction cable to said connection end;

pulling said electrical power line towards the ship; and connecting said connection end of said power line with an electrical interface of the ship in order to provide electrical coupling between the ship and the terminal.

Advantageously, during the traction step, at least a portion of the electrical power line is maintained below the surface of the water.

BRIEF DESCRIPTION OF THE DRAWINGS

Other features and advantages of the method and the device of the invention appear on reading the following description given by way of non-limiting indication with reference to the accompanying drawings, in which.

DETAILED DESCRIPTION OF EMBODIMENTS

Figure 1:
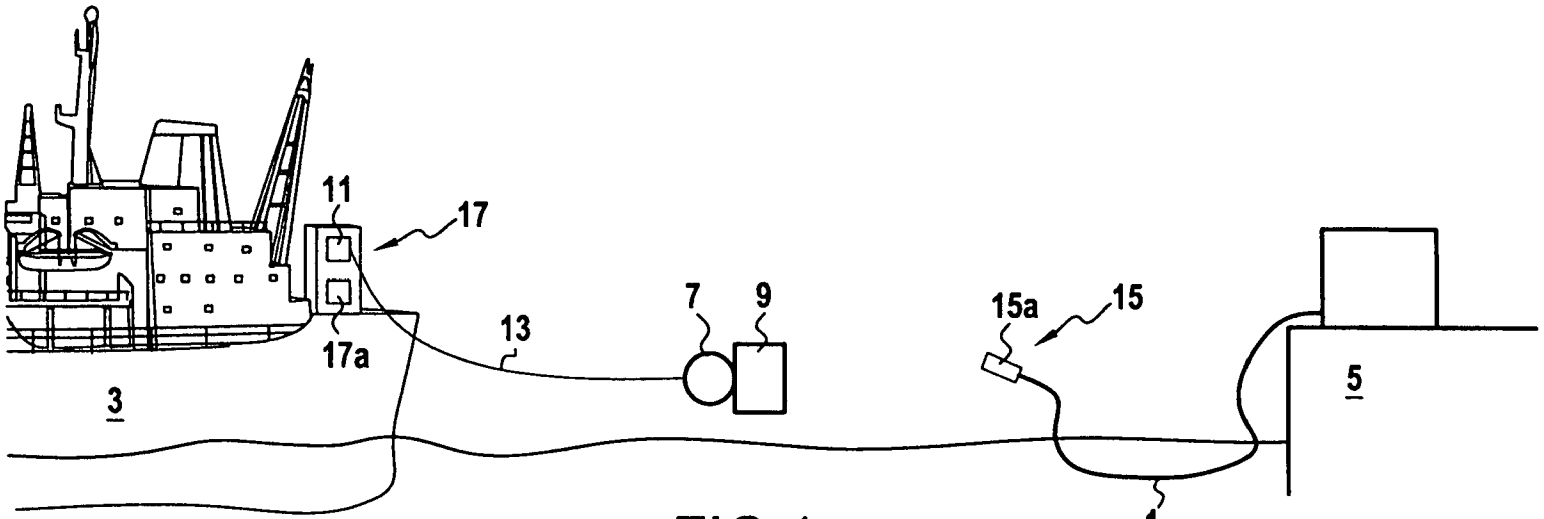
FIG. 1 is a highly diagrammatic view of a device of the invention for connecting an electrical power line between a ship and a terminal.

In accordance with the invention, FIG. 1 is a highly diagrammatic view of a device for connecting an electrical power line 1 between a ship 3 and a terminal 5.

The connection device comprises unwinder means 7, lashing means 9, and traction means 11.

The unwinder means 7 are for unwinding a traction cable 13 from the ship 3 towards a connection end 15 including the connector 15*a* of the electrical power line. The power line 1 may comprise a plurality of electrical connection cables, and it may be stowed in a storage zone at the terminal 5. It should be observed that the capacity of the electrical power line 1 for transferring electricity may be as great as 30 MW.

The lashing means 9 are for lashing the traction cable 13 to the connection end 15 of the electrical power line 1.

The traction means 11 are designed to use the traction cable 13 to pull the electrical power line 1 towards a connection point or zone 17 of the ship 3 so as to connect the connection end 15 with an electrical interface 17*a*. This enables electrical coupling to be provided between the ship 3 and the terminal 5.

In addition, the electrical coupling can be disconnected quickly and simply by unwinding the free end 13 of the traction cable and then letting it go. This enables the ship 3 to be completely released from the terminal 5.

Figure 2:
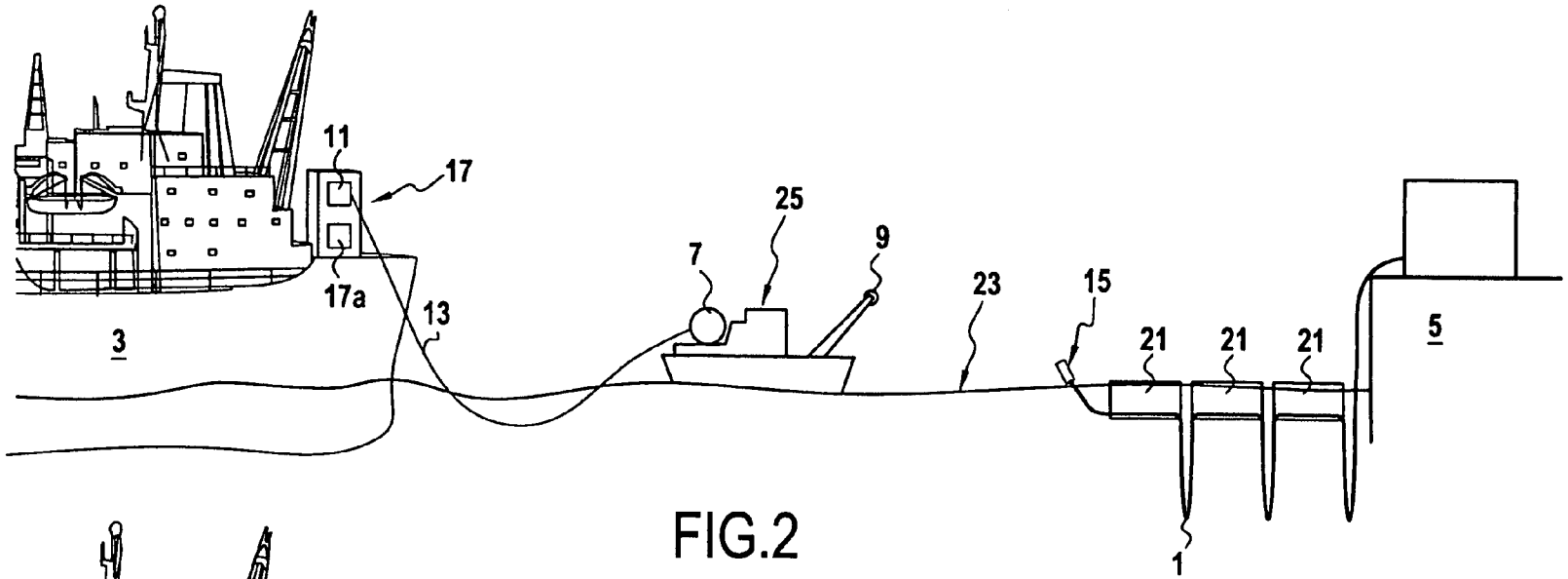
FIGS. 2 and 3 are highly diagrammatic views of embodiments of the FIG. 1 connection device.

FIG. 2 is a highly diagrammatic view showing an embodiment of the device for connecting the electrical power line 1 between the ship 3 and the terminal 5 in which the power line 1 is under water.

The electrical connection or coupling device in this example includes float means 21, e.g. a series of floats 21, for holding at least a portion of the power line 1 under the free surface 23 of the water while it is being transported between the terminal 5 and the ship 3.

Thus, since the power line 1 is under water, it is not exposed to the risks of operating in an atmosphere that is potentially explosive, e.g. in the event of the terminal 5 being a gas terminal and/or the ship 3 being of the methane tanker type.

In addition, the connection device in this example includes a pilot boat 25 that corresponds to the unwinder means 7 and the lashing means 9.

Thus, maneuvers performed to make the connection are as simple as those required for installing or casting off mooring lines and do not require additional crew.

Figure 3:
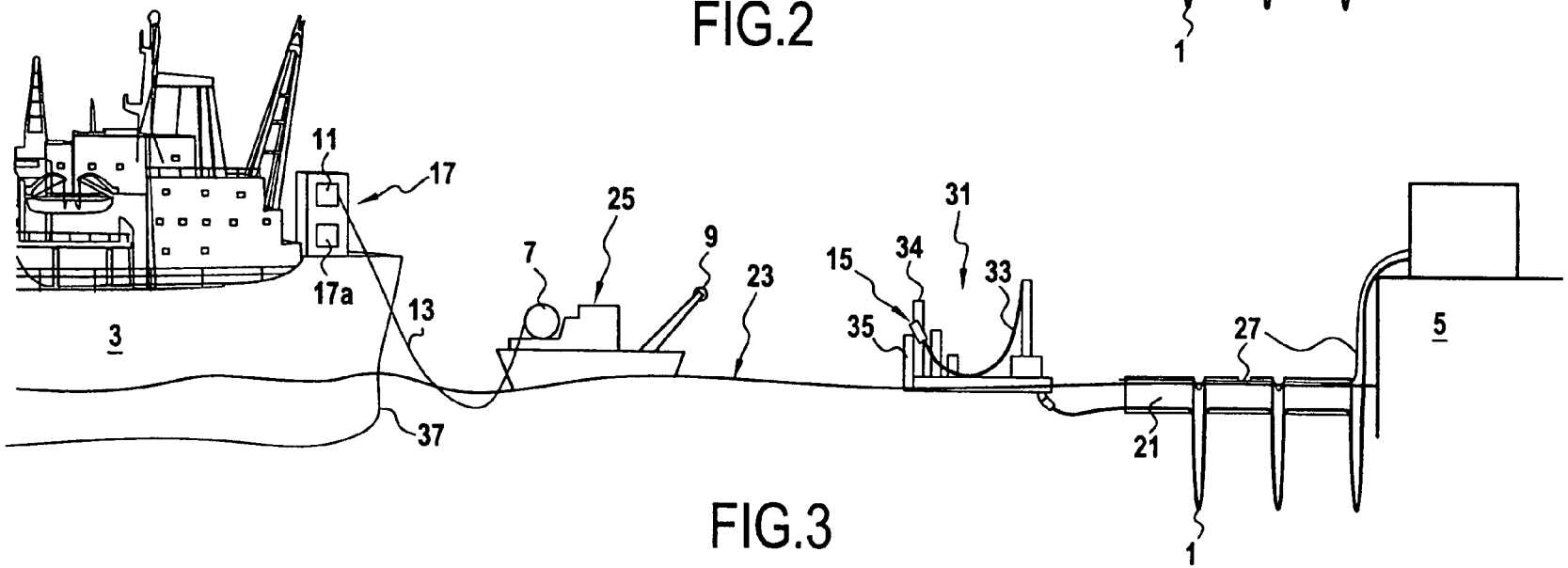

FIG. 3 is a highly diagrammatic view of another example of a connection device that differs from the device of FIG. 2 in that it further includes return means 27 and a barge 31.

Advantageously, the return means 27 are designed to return the power line 1 to the terminal 5 when the power line 1 is disconnected from the ship and the traction cable 13 is released. The return means 27 may correspond to a return cable 27 (as shown) or to using a boat 25, or to using propulsion means (not shown) on board the float means 21 or the barge 31.

The barge 31 serves to support a terminal portion 33 of the power line 1 including the connection end 15. Thus, the barge 31 may include support means 34 for supporting the last above-water segment of the terminal portion 33 of the power line 1.

In addition, the barge 31 may include protection means 35 or fenders enabling it to bear against the hull 37 of the ship 3.

The terminal portion 33 of the power line 1 as stored on the barge 31 may optionally include a double-walled covering.

Figure 4:
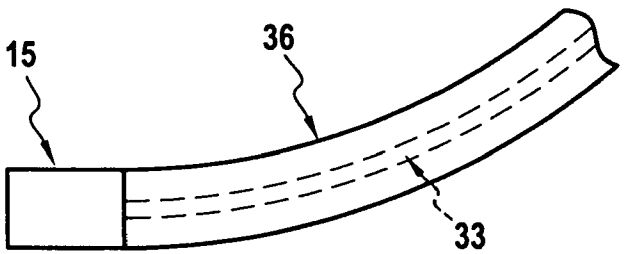
FIG. 4 is a highly diagrammatic view of a terminal portion of the FIG. 1 power line.

In order to avoid risks in an atmosphere that is potentially explosive, the above-water terminal portion 33 of the power line 1 may optionally be provided with a double-walled covering 36 as shown in FIG. 4. In addition to creating two barriers against the outside, the double-walled covering 36 makes it possible, advantageously, to cool the electrical conductors of the power line 1 by means of water or some other fluid.

In a variant (see FIGS. 6A and 6B) the hull of the barge 31 may include an opening that enables the terminal portion 33 of the power line 1 to be stored beneath the barge 31. In this configuration, the support means 34 can be simplified or even omitted.

FIGS. 5A to 5D show various connection or disconnection steps between the ship 3 and the terminal 5 when using the connection device of FIG. 3.

Figure 5A:
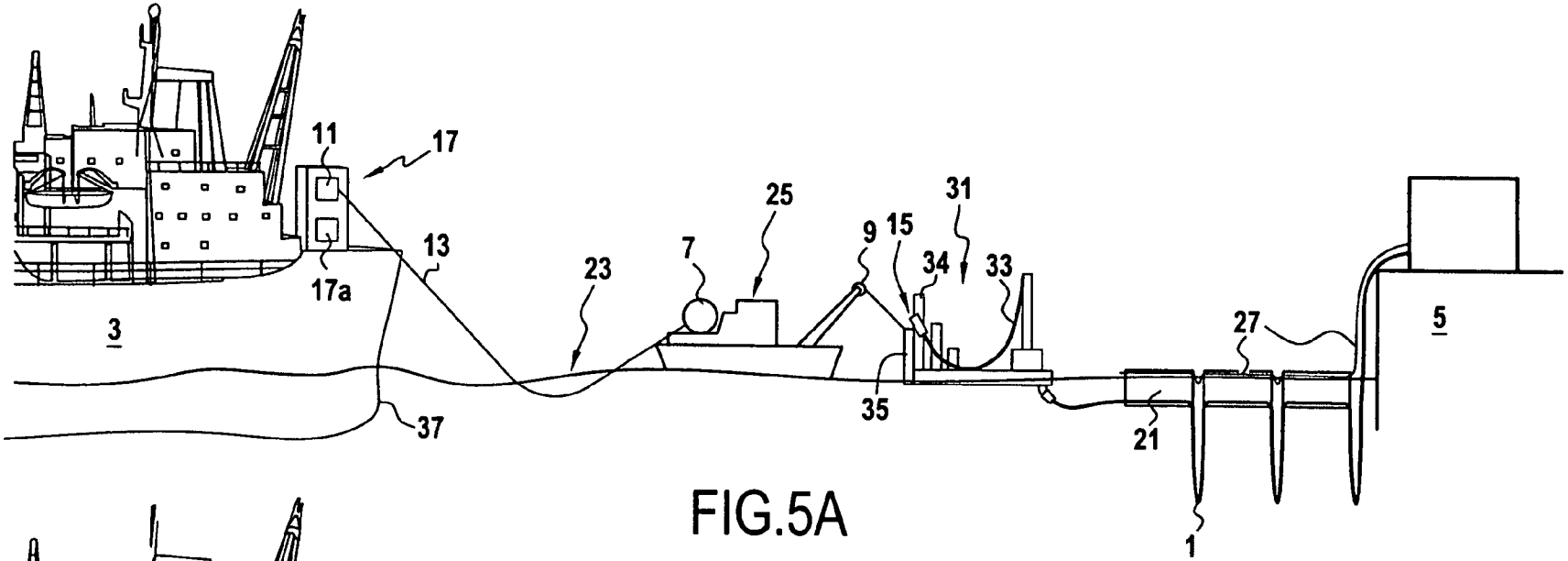
FIGS. 5A to 5D show different steps during connection or disconnection between the ship and the terminal using the connection device of FIG. 3.

FIG. 5A shows the initial step in which the boat 25 brings the traction cable 13 from the ship 3 to the barge 31 in order to secure it to the connection end 15 of the power line 1.

Figure 5B:
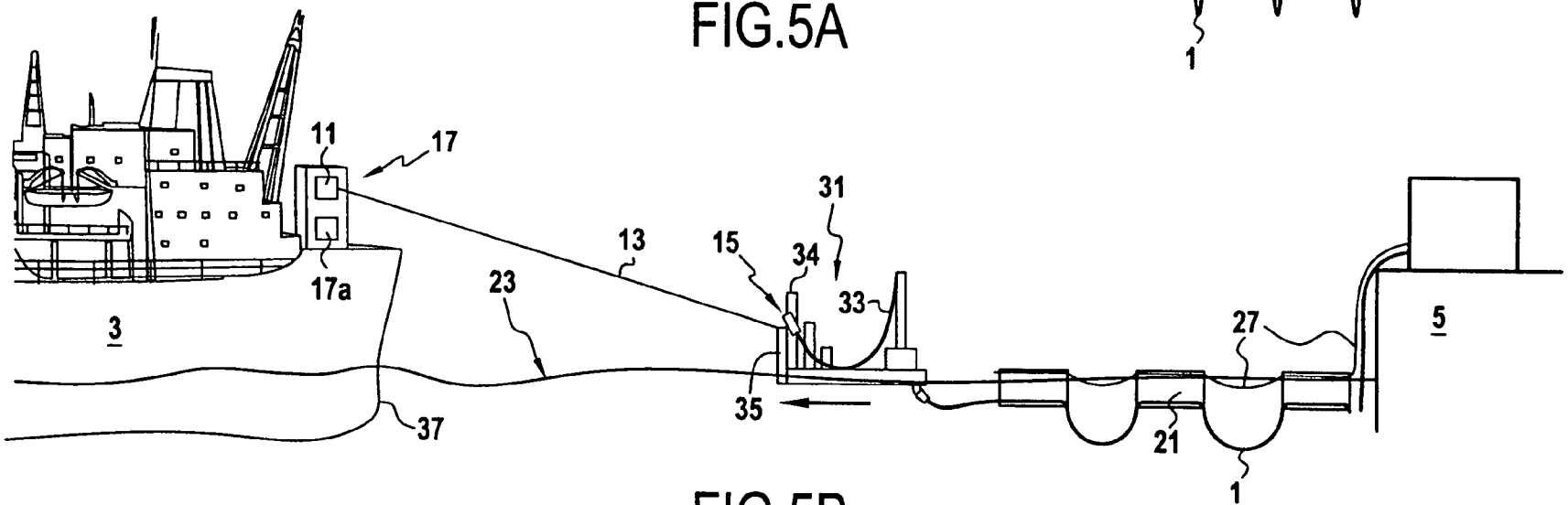

FIG. 5B shows the step of pulling the barge 31 and its floats 21 supporting the under-water power line from their storage zone towards the ship 3. The traction means 11 may comprise a winch (see FIG. 7A) placed on the ship 3 for pulling the connection end 15 of the power line 1 via the traction cable 13. Thus, during the traction step, at least a portion of the electrical power line 1 is maintained beneath the surface 23 of the water. It should be observed that this step is analogous to the simple conventional operation of taking up slack in moorings.

Figure 5C:
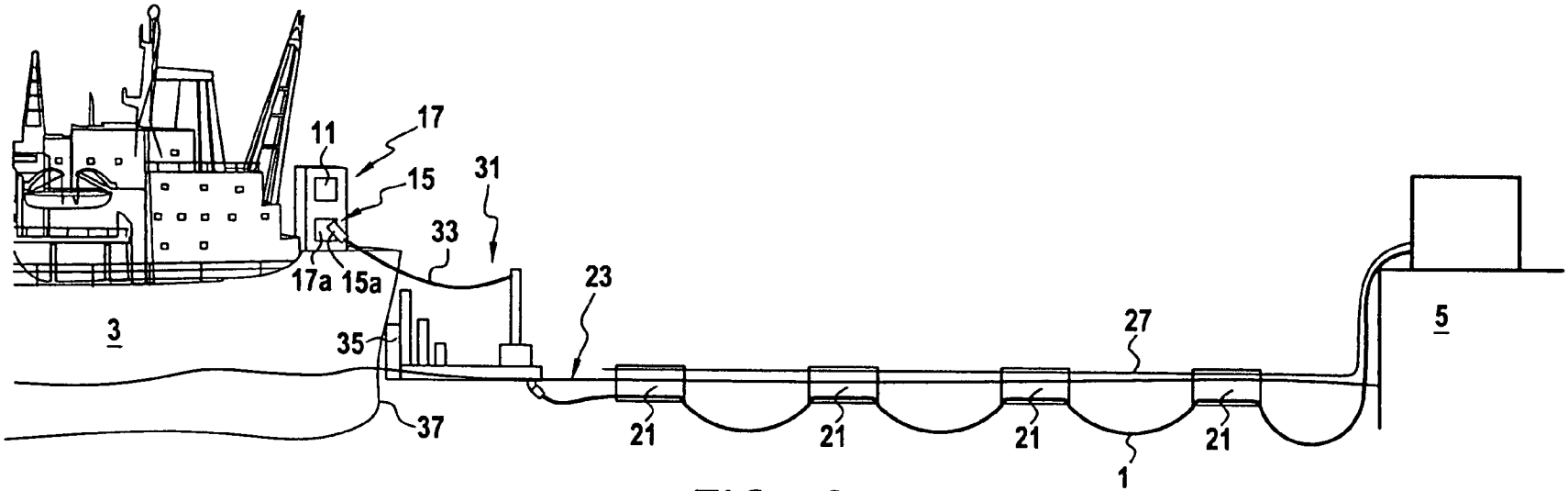

FIG. 5C shows the step of establishing electrical coupling between the ship 3 and the terminal 5. In this step, the traction cable 13 pulls the connection end 15 of the power line 1 until the barge 31 bears against the hull 37 of the ship 3, and the connector 15*a* is connected to the electrical interface 17*a* of the ship 3.

Furthermore, disconnection or uncoupling between the ship 3 and the terminal 5 can be implemented simply, merely by releasing the connection end 15 of the power line 1 from the electrical interface 17*a* and from the traction cable 13. Thereafter, the barge 31 and the floats 21 supporting the power line 1 can be returned towards their storage zone by the return means 27, e.g. by the return cable 27. In a variant, the barge 31 and the floats 21 can be returned by the boat 25 or by propulsion means (not shown) on board the barge 31.

It should be observed that the connection and disconnection operations are similar to conventional mooring operations and can be performed by the pilot and crew members who perform mooring maneuvers.

Figure 5D:
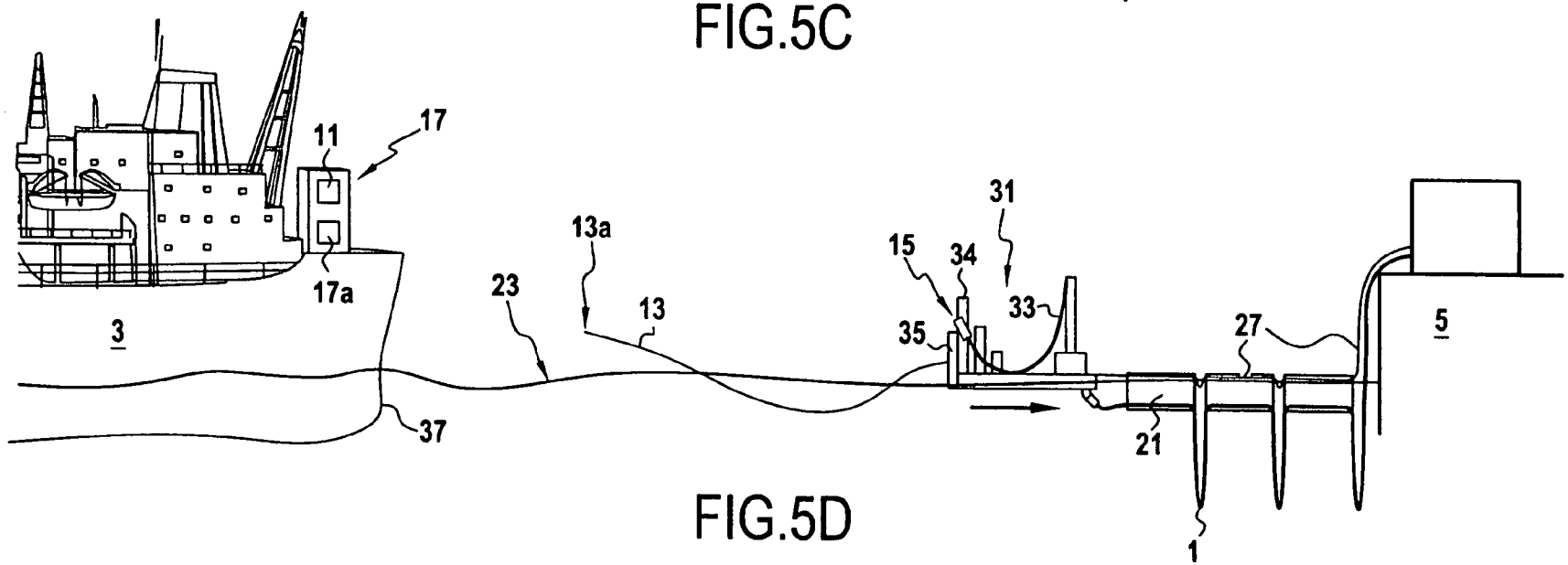

FIG. 5D shows a rapid disconnection step. In an emergency, once the connection end 15 has been released, the traction cable 13 can be cast off so as to allow the above-water portion of the power line 1 to drop down onto the support means 34 of the barge 31.

Thus, in an emergency, the ship 3 can in a very short time (a few minutes) be released completely from the terminal 5 by unwinding and then letting go the end 13*a* of the traction cable 13. Thereafter, the return means 27 can move the power line 1 away from the ship 3.

Figure 6A:
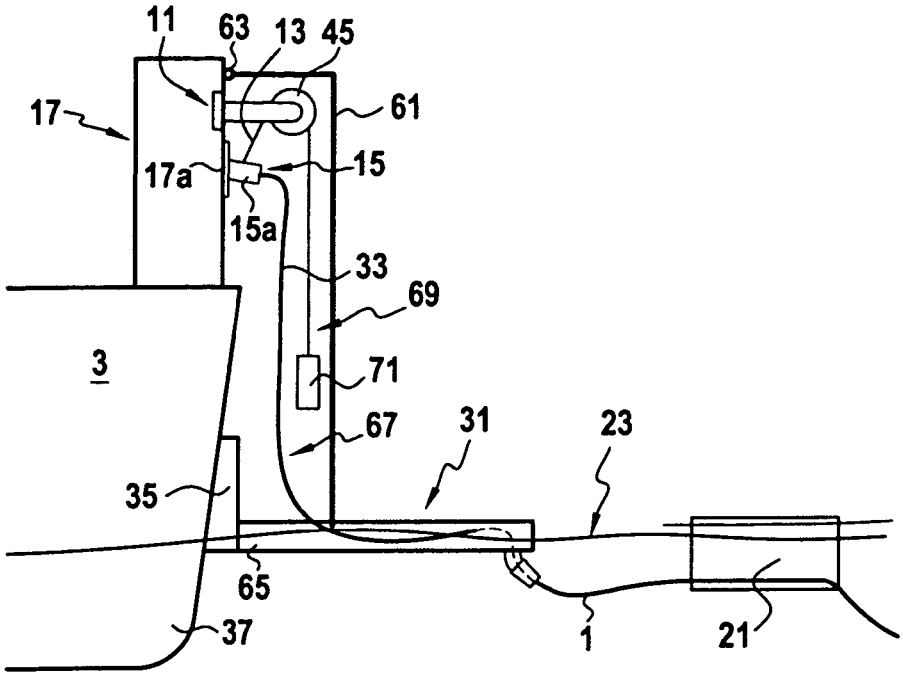
FIGS. 6A to 6C are highly diagrammatic views showing variants of a barge of the connection device of the invention.

FIG. 6A shows a variant of the barge 31 that serves in particular to satisfy the need to isolate the above-water portion of the power line 1 from the possibly explosive atmosphere.

In this example, the barge 31 includes an airtight caisson 61 provided with gaskets 63, which caisson surrounds the above-water or terminal portion 33 of the power line 1. Thus, the caisson 61 co-operates with the hull 37 of the ship 3, the hull 65 of the barge 31, and the surface 23 of the water to form an airtight zone or closed volume 67 that is airtight relative to the outside.

Optionally, in order to obtain even more effective protection against a risk of an explosive atmosphere, it is possible to use a blower (not shown) placed on the ship 3 or the barge 31. The blower is designed to take air from a gas-free zone so as to keep the airtight zone 67 at a slightly raised pressure.

Another solution would be to perform this function by using a source of inert gas, e.g. nitrogen, and filling the airtight zone 67 with the inert gas. Such inert gas can be available on board the ship 3, or on board the barge 31, or from the terminal 5.

This example shows that the traction means 11 include a winch 45 for using the cable 13 to pull the connection end 15 of the power line 1.

Optionally, the traction means 11 may include suspension means 69 for compensating the weight of the power line 1.

The suspension means 69 serve to facilitate maneuvering by compensating for the weight of the power line 1 by means of a suspension system connected to a weight or springs 71.

In the configuration of the FIG. 6A example, it is advantageous for the power line 1 to be stored under the barge 31.

Figure 6B:
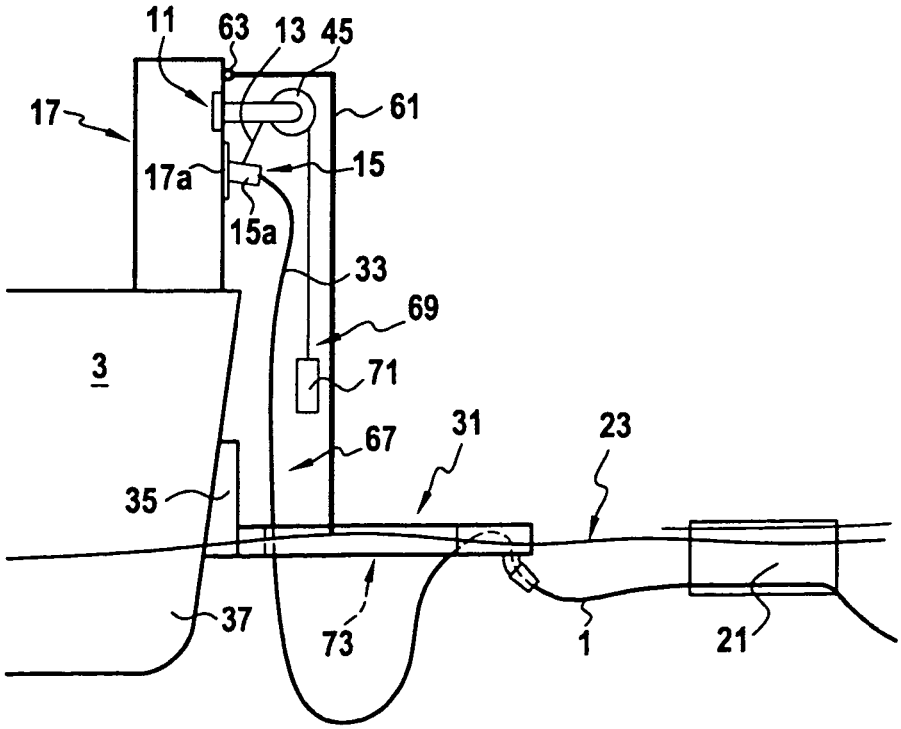

FIG. 6B shows that the hull of the barge 31 is provided with an opening 73 or that the barge 31 is of the catamaran type so as to allow the power line 1 to be stored by being suspended under the barge 31.

Figure 6C:
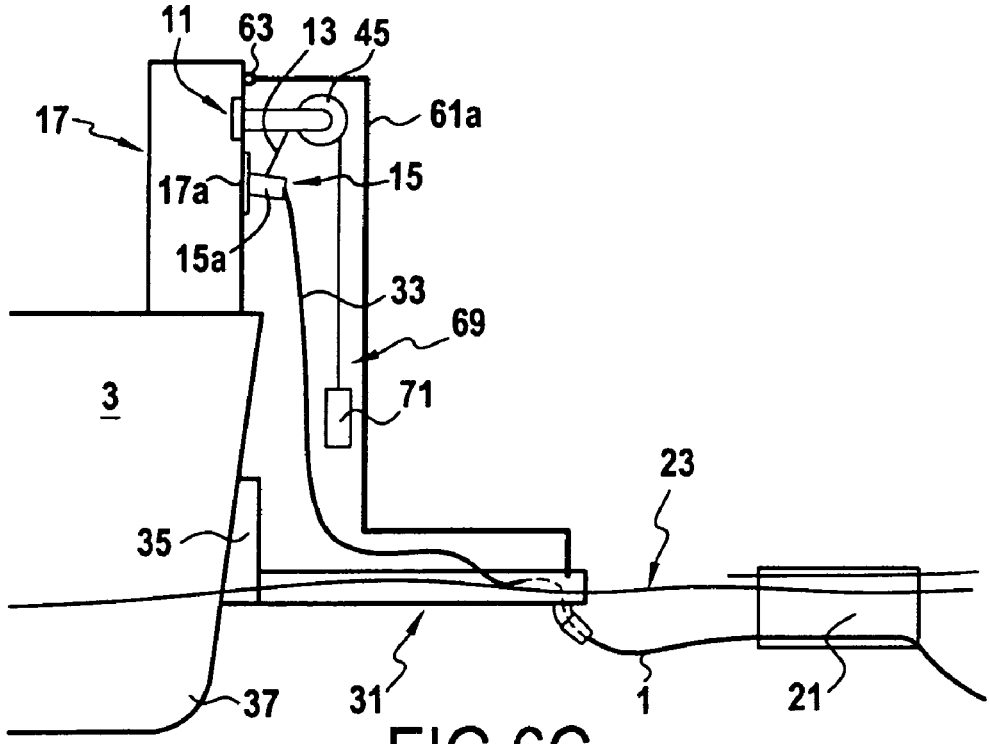

FIG. 6C shows another variant of the barge 31 that differs from that of FIG. 6A solely by the fact that the barge 31 has an airtight caisson 61*a* of sufficient volume to provide protection and storage of the power line 1 inside it and out of the water. Thus, when the barge 31 is next to the ship 3 and the power line 1 is activated, the airtight caisson 61*a* can provide protection against a potentially explosive atmosphere.

Figure 7A:
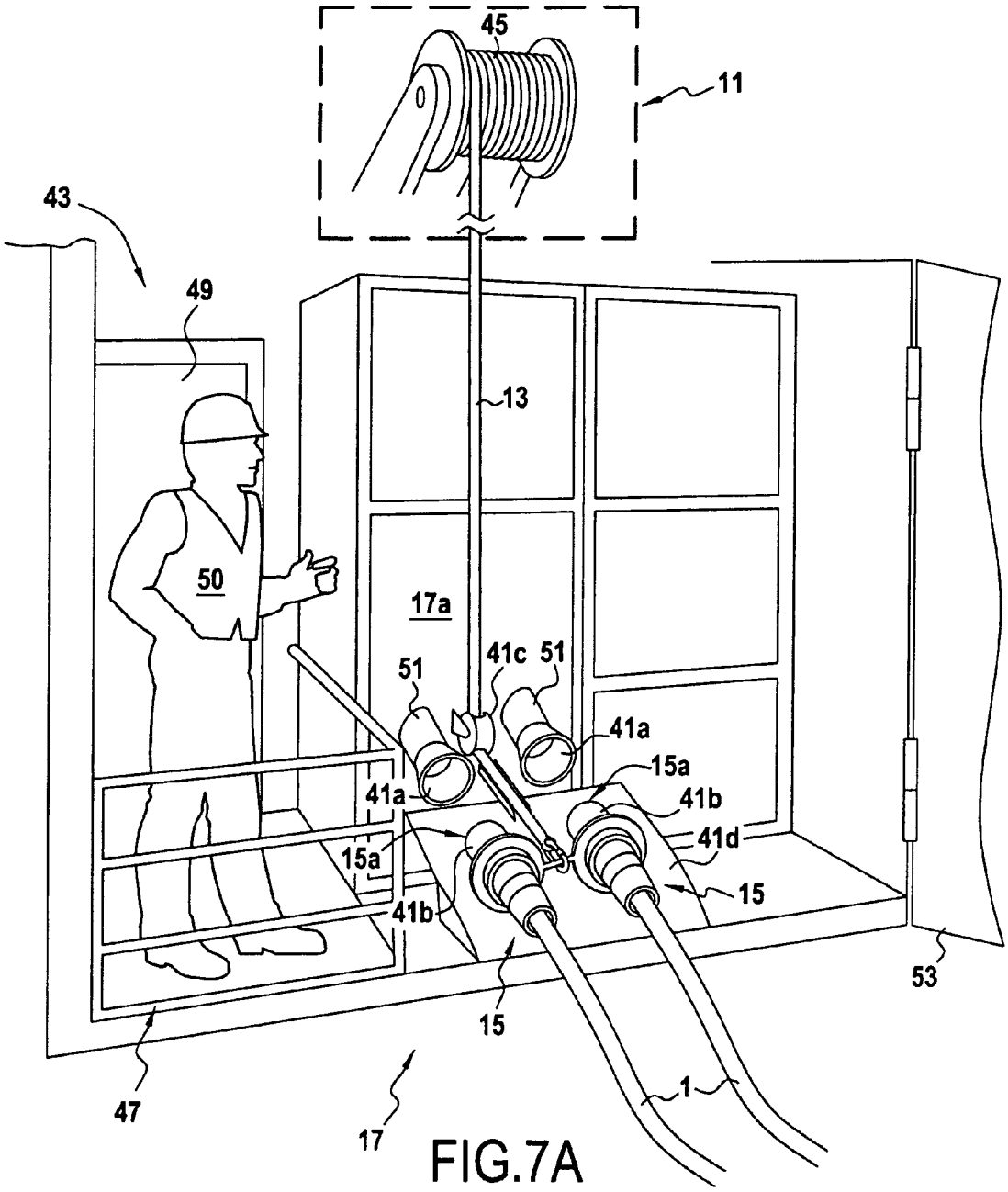
FIGS. 7A and 7B are highly diagrammatic views of variants of a connection zone on board the ship of the invention.

FIG. 7A shows in greater detail the connection zone 17 on board the ship 3. This example shows that the connection device may include guide means 41*a* to 41*d* enabling the connection end 15 to be guided and connected to the electrical interface 17*a* of the ship 3 so as to provide electrical coupling between the ship 3 and the terminal 5 in automatic manner.

The connection zone 17 may correspond to an opening 43 in the hull 37 of the ship 3, including the traction means 11 that may comprise the winch 45, the guide means 41*a* to 41*d*, the electrical interface 17*a*, and a control station 47.

By way of example, this figure shows that the power line 1 has two electrical cables with ends that are pulled by the winch 45 acting on the cable 13. Naturally, the power line could comprise an arbitrary number of electric cables.

The control station 47 may be accessible via a watertight door 49 to allow a crew member 50 to maneuver the winch 45 for controlling a connection or disconnection operation.

The guide means 41*a* to 41*d* may include male and female docking means 41*b* and 41*a* that provide final mechanical guidance for the connection end 15 towards socket means 51 of the electrical interface 17*a* for connecting the connector(s) 15*a* to the socket means 51.

Optionally, the guide means 41*a* to 41*d* may include an intermediate sheave 41*c* and a ramp 41*d* for facilitating guidance and centering of the connector(s) 15*a* in the socket means 51.

In addition, the opening 43 in the hull 37 may be provided with a watertight closure cover 53 enabling it to be closed when the electrical interface 17*a* is inactive.

Figure 7B:
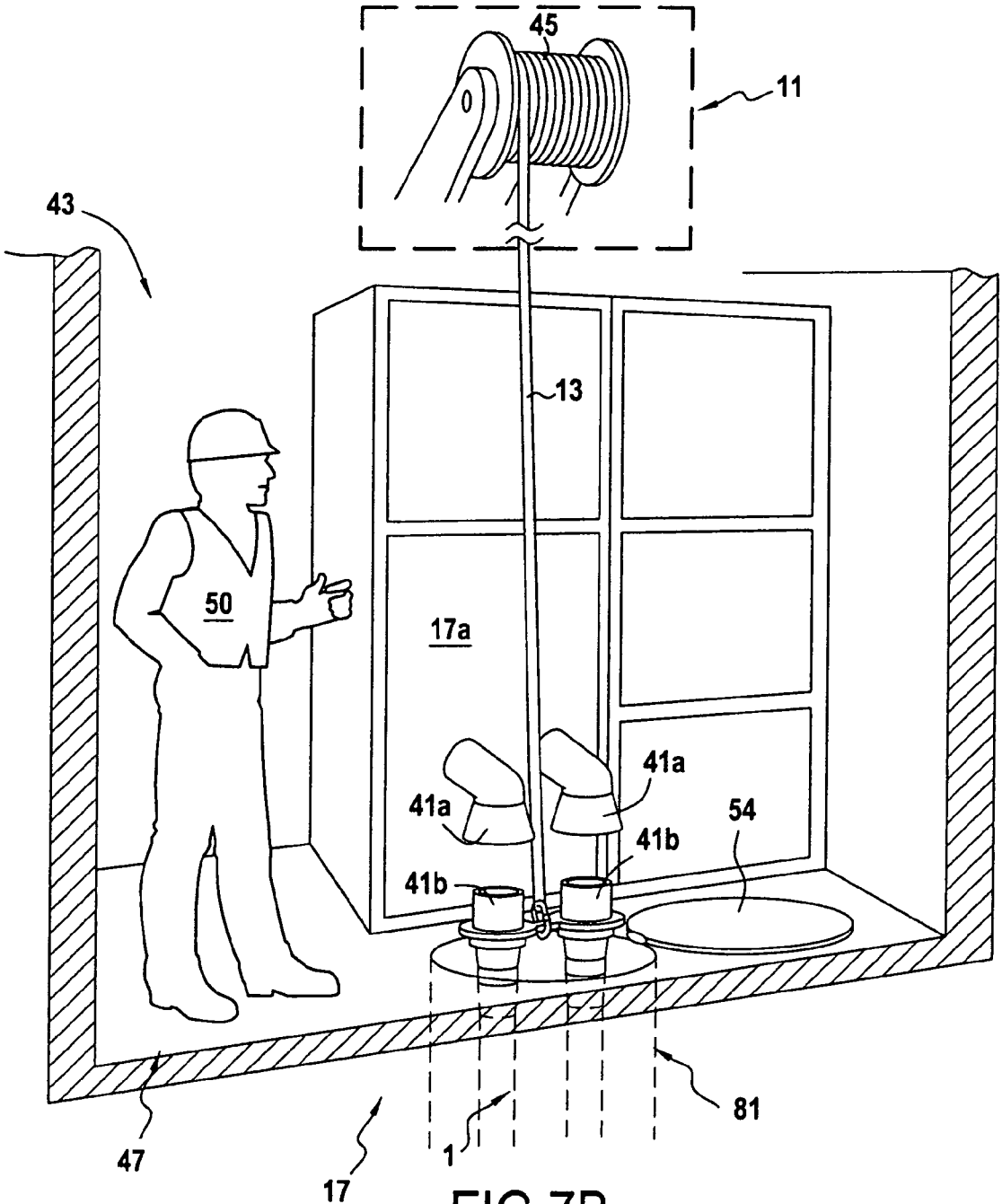

FIG. 7B shows another embodiment that differs from that of FIG. 7A by the fact that the connection zone 17 is situated inside the ship 3.

In this example, the hull 37 of the ship 3 includes a duct 81 for passing the power line 1. This duct 81 is provided with a watertight closure hatch 54 enabling it to be closed when the electrical interface 17*a* is inactive.

As before, the guide means 41*a* to 41*d* may comprise male and female docking means 41*b*, 41*a* for providing final mechanical guidance to the connection end 15 towards the socket means 51 of the electrical interface 17*a* in order to connect the connector(s) 15*a* to said socket means 51.

In this example, the female docking means 41*a* of the electrical interface 17*a* are disposed in such a manner as to receive the connection end 15 of the power line 1 leaving the duct 81 in a substantially vertical direction.

Figure 8A:
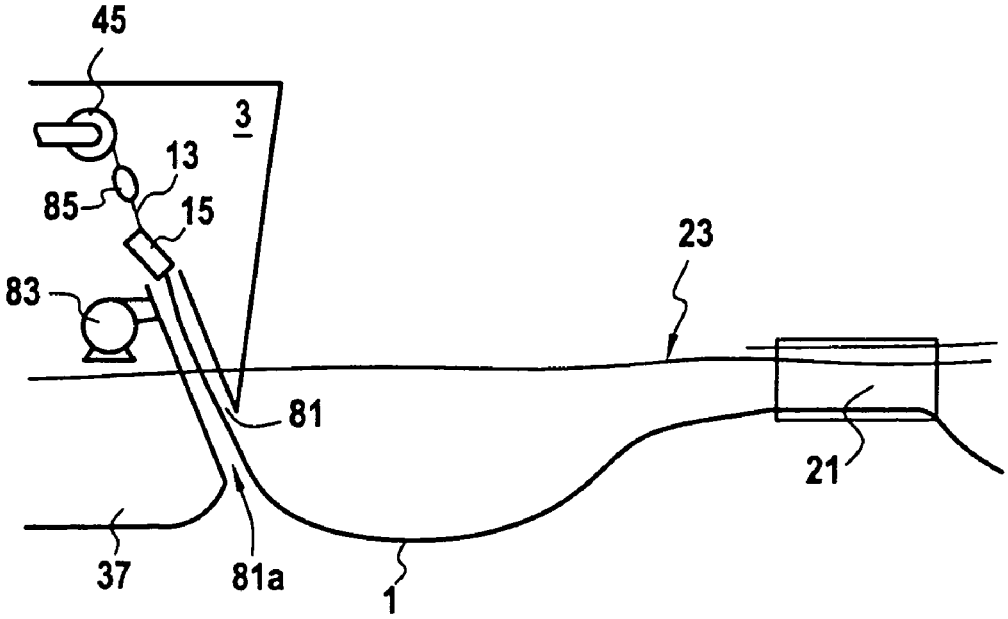
FIGS. 8A to 8C are highly diagrammatic views of variants of a duct in the hull of the ship of the invention for passing the power line.

FIG. 8A is a diagram showing a ship 3 with a hull 37 that includes a duct 81 for passing the power line 1 and that opens out below the water line 23.

The power line 1 can be pulled from inside the hull 37 of the ship by the winch 45 so as to pass through the airtight duct 81, which duct may also be put under air or nitrogen pressure by means of a blower 83. By virtue of the opening 81*a* of this duct 81 being situated below the water line 23, it is possible to protect the power line 1 from any explosive atmosphere.

It should be observed that in this configuration, the end of the traction cable 13 is provided with a submersible buoy 85 that makes it possible, once it has passed through the opening 81*a*, to bring this end of the traction cable 13 to the surface where it can be connected by the boat crew to the connection end 15 of the power line 1.

Figure 8B:
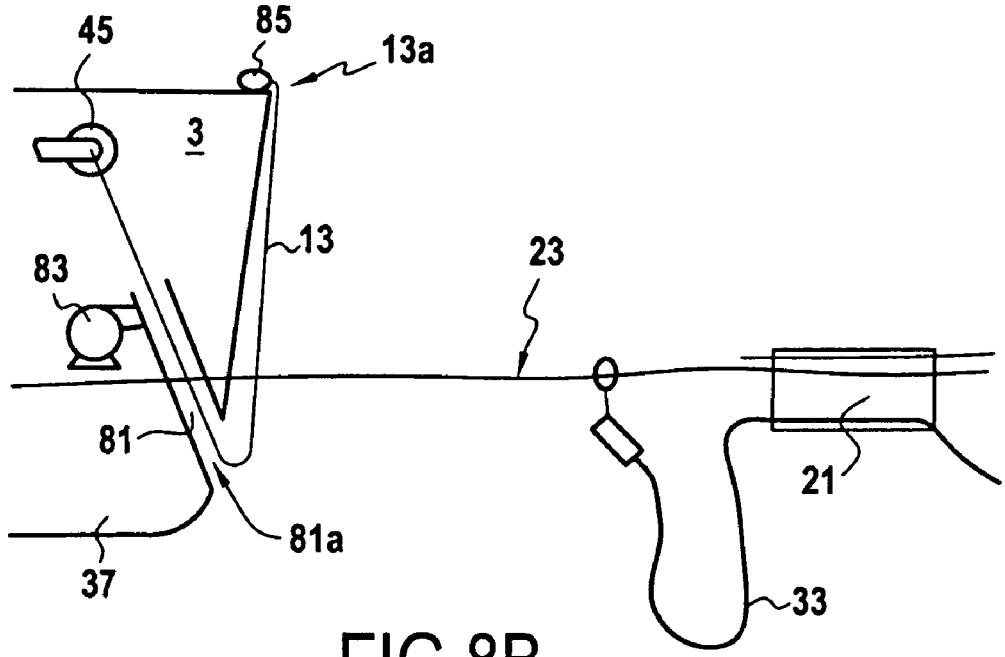

FIG. 8B shows that the end 13*a* of the traction cable 13, possibly fitted with a buoy 85, can remain on one side of the ship 3 while it is at sea. When the connection is to be established, this end 13*a* is sent towards the boat for connection to the connection end 15 of the power line 1, thereby enabling the power line 1 to be put into place, even when the opening 81*a* of the duct 81 lies below the water line 23.

Figure 8C:
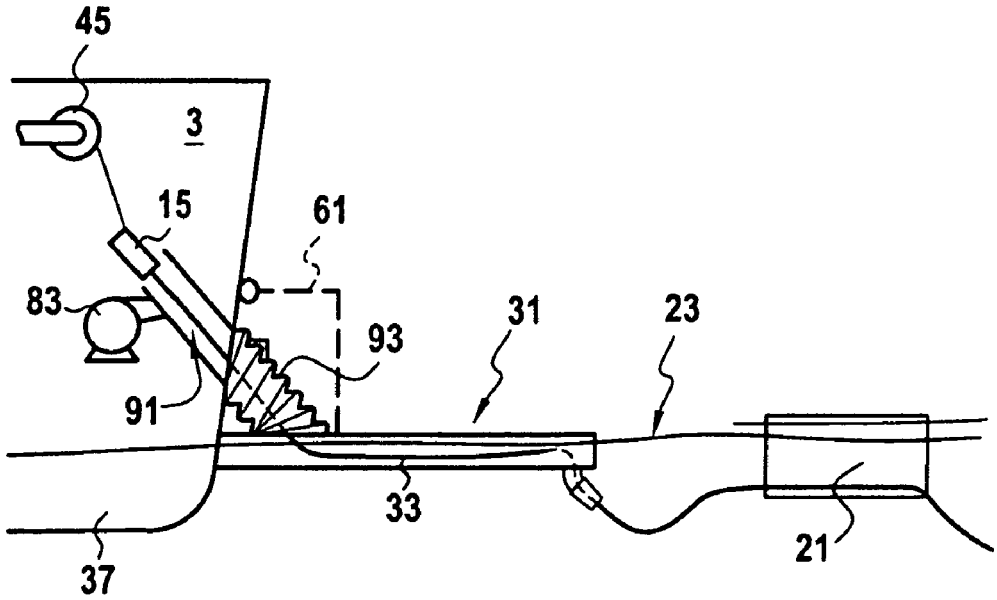
Figure 9:
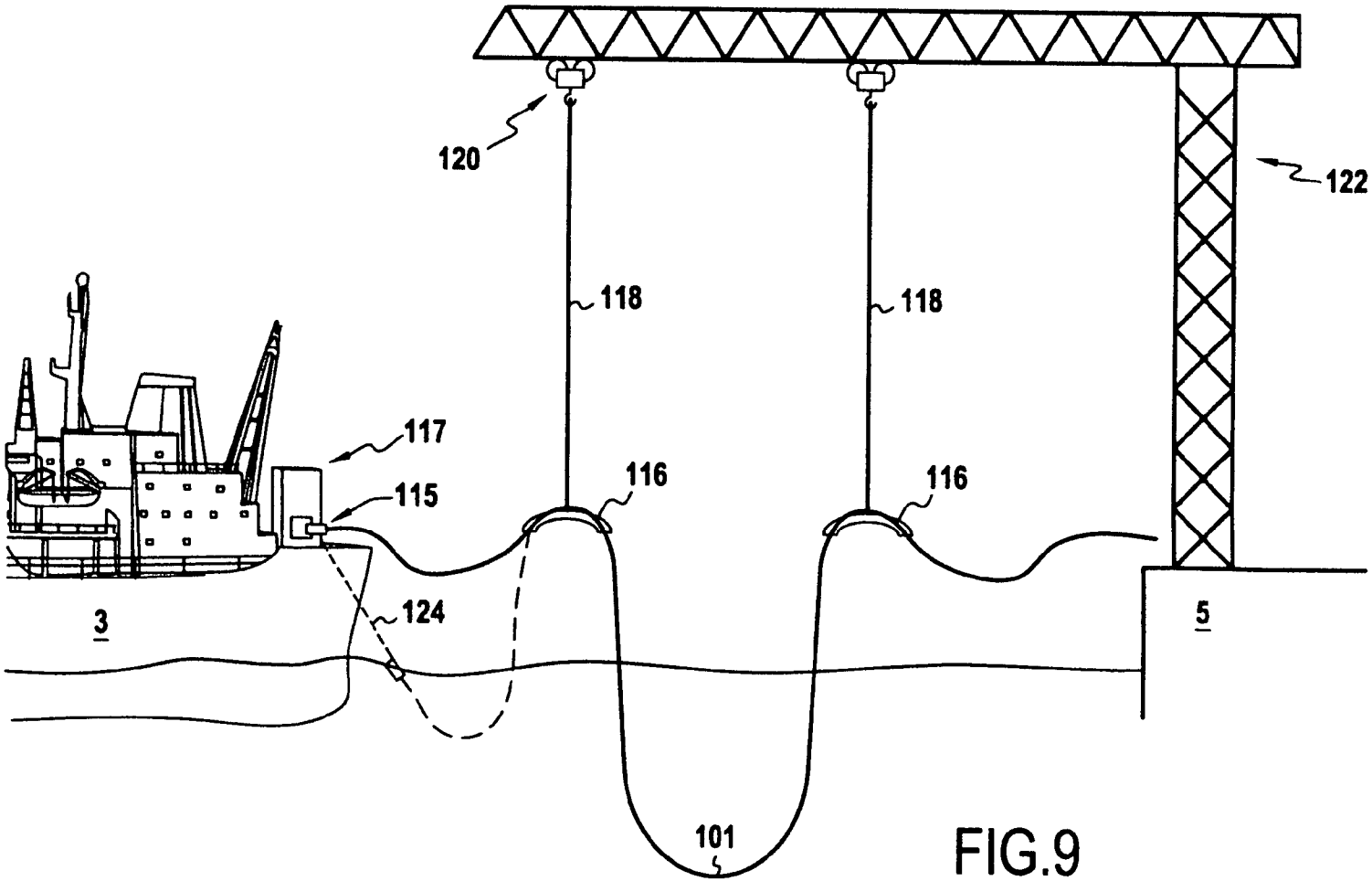
FIG.9 PRIOR ART
FIG. 9 is a highly diagrammatic view of a prior art device for connecting an electrical power line between a ship and a terminal.

FIG. 8C shows a variant of FIG. 8A. In this example, the hull 37 of the ship 3 includes a duct 91 for passing the power line 1, which duct opens out below the water line 23. In this example, the terminal portion 33 of the power line 1 outside the duct 91 can be protected from a possibly explosive atmosphere by a flexible gastight covering 93 that extends the duct 91, or alternatively by a caisson 61 (as shown in FIG. 6A) or a caisson 61*a* (as shown in FIG. 6C).

It should be observed that in the configurations shown in FIGS. 8A to 8C, the guidance of the power line 1 is simplified since it is ensured in part by the duct 81 or 91.

Thus, in accordance with the invention, the power line 1 is adapted to feed the ship 3 with electricity from the terminal 5, or vice versa to feed the terminal 5 from the ship 3.

The ship 3 (e.g. a methane tanker) may include an electricity generator (not shown) for powering the terminal 5 electrically via the power line 1. Thus, a fraction of the energy produced by the electricity generator of the ship 3 can be fed to the gas terminal 5.

Advantageously, the present invention provides electrical connection means that are as easy to put into place as a mooring.

These electrical connection means comprise the following advantages:

- the time required for connection and disconnection maneuvers is less than about 15 minutes;
- the maneuvers are as simple as those needed for putting into place or casting off mooring lines, and do not require additional personnel;
- it has the capacity to exchange electrical power of about 30 MW; and
- it is compatible with the safety requirements applicable to methane tankers and terminals.

The invention claimed is:

1. A device for connecting an electrical power line between a ship and a terminal, the device being characterized in that it includes:

- unwinder means for unwinding a traction cable from the ship towards a connection end of said electrical power line;
- lashing means for lashing said traction cable to said connection end;
- traction means for pulling said electrical power line towards the ship so as to connect said connection end with an electrical interface of the ship;
- float means for maintaining at least a portion of said power line below the surface of the water;
- return means for returning the power line towards the terminal when said power line is disconnected from the ship and the traction cable is released;
- guide means for guiding said connection end towards said electrical interface so as to provide electrical coupling between the ship and the terminal; and
- a barge for supporting a terminal portion of the power line including said connection end, said barge including protection means for bearing against the hull of the ship.

2. A device according to claim 1, characterized in that the hull of said barge includes an opening enabling said terminal portion of the power line to be stored beneath the barge.

3. A device according to claim 1, characterized in that said terminal portion of the power line is stored on the barge and includes a double-walled covering.

4. A device for connecting an electrical power line between a ship and a terminal, the device comprising:

- unwinder means for unwinding a traction cable from the ship towards a connection end of said electrical power line;
- lashing means for lashing said traction cable to said connection end; and,
- traction means for pulling said electrical power line towards the ship so as to connect said connection end with an electrical interface of the ship, characterized in that it includes a barge for supporting a terminal portion of the power line including said connection end, said barge including protection means for bearing against the hull of the ship.

5. A device according to claim 4, characterized in that it includes float means for maintaining at least a portion of said power line below the surface of the water.

6. A device according to claim 4, characterized in that it includes return means for returning the power line towards the terminal when said power line is disconnected from the ship and the traction cable is released.

7. A device according to claim 4, characterized in that it includes guide means for guiding said connection end towards said electrical interface so as to provide electrical coupling between the ship and the terminal.

8. A device according to claim 4, characterized in that the hull of said barge includes an opening enabling said terminal portion of the power line to be stored beneath the barge.

9. A device according to claim 4, characterized in that said terminal portion of the power line is stored on the barge and includes a double-walled covering.

10. A device according to claim 4, characterized in that said barge includes a caisson including gaskets surrounding the above-water portion of the power line and cooperating with the hull of the ship, with the hull of the barge, and with the water surface to form a zone that is airtight relative to the outside.

11. A device according to claim 10, characterized in that it includes a blower located on the ship or the barge for raising the pressure in said airtight zone, said blower taking air from a gas-free zone.

12. A device according to claim 10, characterized in that it includes a source of inert gas for filling said airtight zone with inert gas.

13. A device according to claim 4, characterized in that the traction means comprise a winch located on the ship for using the traction cable to pull the connection end of said power line.

14. A device according to claim 4, characterized in that the traction means include suspension means for compensating the weight of said power line.

15. A ship including an electrical interface for coupling electrically to a terminal, the ship including:

unwinder means for unwinding a traction cable towards a connection end of an electrical power line connected to the terminal;

lashing means for lashing said traction cable to said connection end;

traction means for pulling said electrical power line towards the ship in order to connect said connection end with said electrical interface; and, in the hull of the ship, a duct for passing the power line, said duct opening out below the water line, characterized in that the end of the traction cable includes a submersible buoy.

16. A ship according to claim 15, characterized in that the hull of the ship includes a duct for passing the power line and opening out beneath the water line, and in that the duct is extended by a gastight covering.

17. A ship according to claim 15, characterized in that it includes guide means including docking means for guiding said connection end of said power line towards socket means of the electrical connection interface.

18. A ship according to claim 15, characterized in that said duct includes a watertight protection hatch.

19. A ship according to claim 15, characterized in that said electrical connection interface includes a watertight protective cover.

20. A ship according to claim 15, characterized in that it includes a control station that is accessible via a watertight door of the ship.

21. A ship according to claim 15, characterized in that:

the traction means comprise a winch located on the ship for using the traction cable to pull the connection end of said power line;

the traction means include suspension means for compensating the weight of said power line.

22. A ship according to claim 15, characterized in that it includes guide means including docking means for guiding said connection end of said power line towards socket means of the electrical connection interface.

23. A ship according to claim 15, characterized in that it includes a control station that is accessible via a watertight door of the ship.

24. A method of connecting an electrical power line between a ship and a terminal, the method being characterized in that it comprises the following steps:

unwinding a traction cable from the ship towards a connection end of said electrical power line;

lashing said traction cable to said connection end;

pulling said electrical power line towards the ship;

connecting said connection end of said power line with an electrical interface of the ship in order to provide electrical coupling between the ship and the terminal; and, using a barge for supporting a terminal portion of the power line including said connection end.

25. A method according to claim 24, characterized in that during the traction step, at least a portion of the electrical power line is maintained below the surface of the water.

* * * * *